US007330397B2

(12) United States Patent
Ganesan et al.

(10) Patent No.: US 7,330,397 B2
(45) Date of Patent: Feb. 12, 2008

(54) ELECTROMAGNETIC ANTI-JAM TELEMETRY TOOL

(75) Inventors: Harini Ganesan, Sugar Land, TX (US); Nataliya Mayzenberg, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 481 days.

(21) Appl. No.: 10/905,953

(22) Filed: Jan. 27, 2005

(65) Prior Publication Data

US 2006/0164917 A1 Jul. 27, 2006

(51) Int. Cl.
*H04H 9/00* (2006.01)

(52) U.S. Cl. ..... 367/83; 340/854.3; 340/854.6; 340/855.7; 340/603

(58) Field of Classification Search ..... 367/83, 367/81, 82, 84; 73/152.16; 166/177.4, 285, 166/66.5; 175/40; 340/603, 854.3, 854.6, 340/855.7

See application file for complete search history.

(56) References Cited

U.S. PATENT DOCUMENTS 3,739,331 A 6/1973 Godbey et al.
5,249,161 A 9/1993 Jones et al.
6,219,301 B1 4/2001 Moriarty
6,626,253 B2 9/2003 Hahn et al.
6,714,138 B1 * 3/2004 Turner et al. ..... 340/854.3
2002/0117306 A1 * 8/2002 Hahn et al. ..... 166/373
2004/0069535 A1 4/2004 Hahn et al.

FOREIGN PATENT DOCUMENTS

EP 0140788 5/1985
EP 0309030 3/1989

* cited by examiner

*Primary Examiner*—Jeffery Hofsass
*Assistant Examiner*—Sisay Yacob
(74) *Attorney, Agent, or Firm*—James L. Kurka; Kevin P. McEnaney; Dale V. Gaudier

(57) ABSTRACT

A mud-pulse telemetry tool includes a tool housing, a motor disposed in the tool housing, and a magnetic coupling coupled to the motor and having an inner shaft and an outer shaft. The tool may also include a stator coupled to the tool housing, a restrictor disposed proximate the stator and coupled to the magnetic coupling, so that the restrictor and the stator adapted to generate selected pulses in a drilling fluid when the restrictor is selectively rotated. The tool may also include a first anti-jam magnet coupled to the too housing, and an second anti-jam magnet disposed proximate the first anti-jam magnet and coupled to the inner shaft and/or the outer shaft, wherein at least one of the first anti-jam magnet and the second anti-jam magnet is an electromagnet, and wherein the first anti-jam magnet and the second anti-jam magnet are positioned with adjacent like poles.

20 Claims, 5 Drawing Sheets

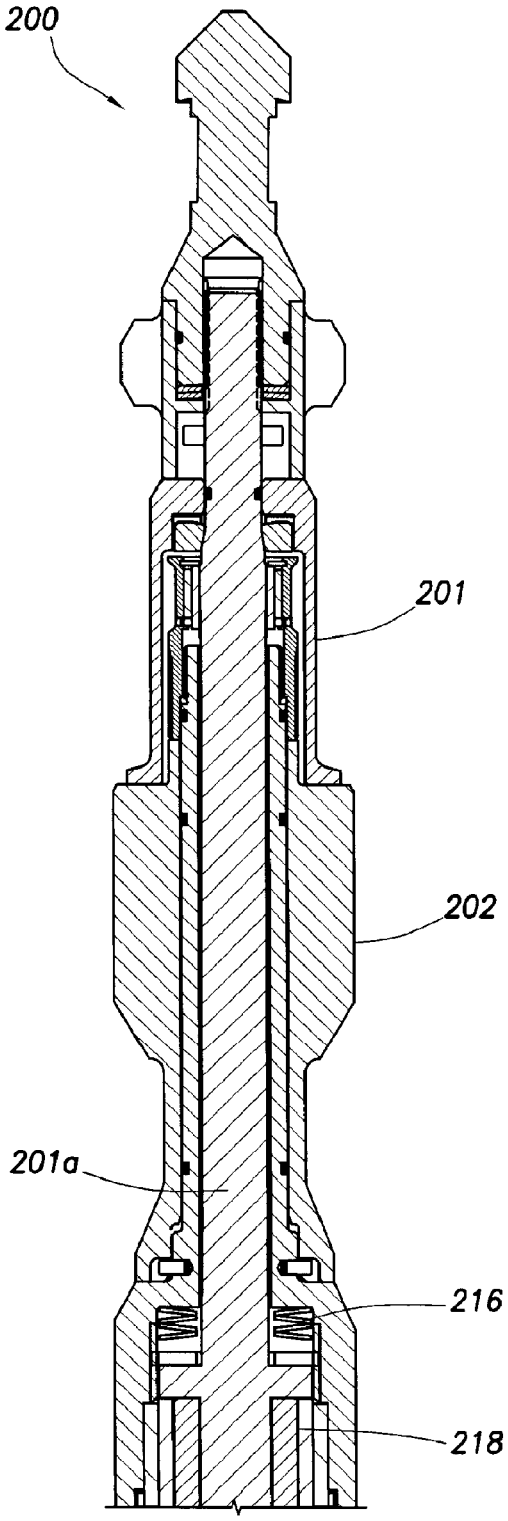
FIG.2A1
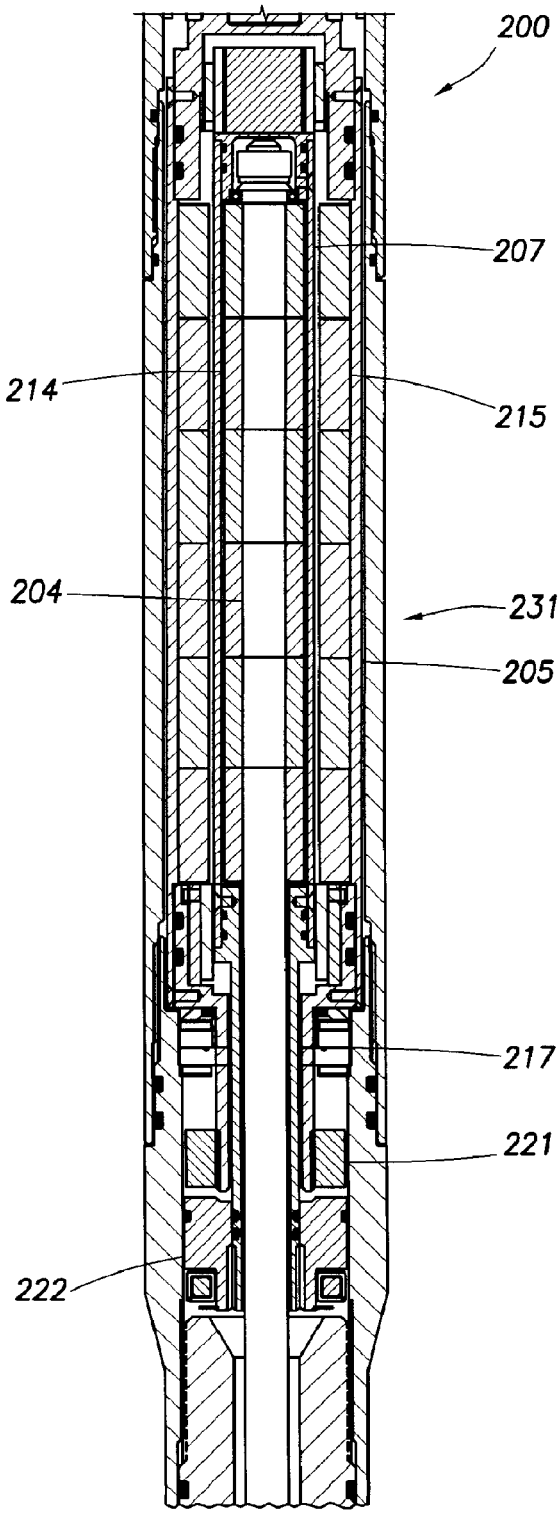
FIG.2A2

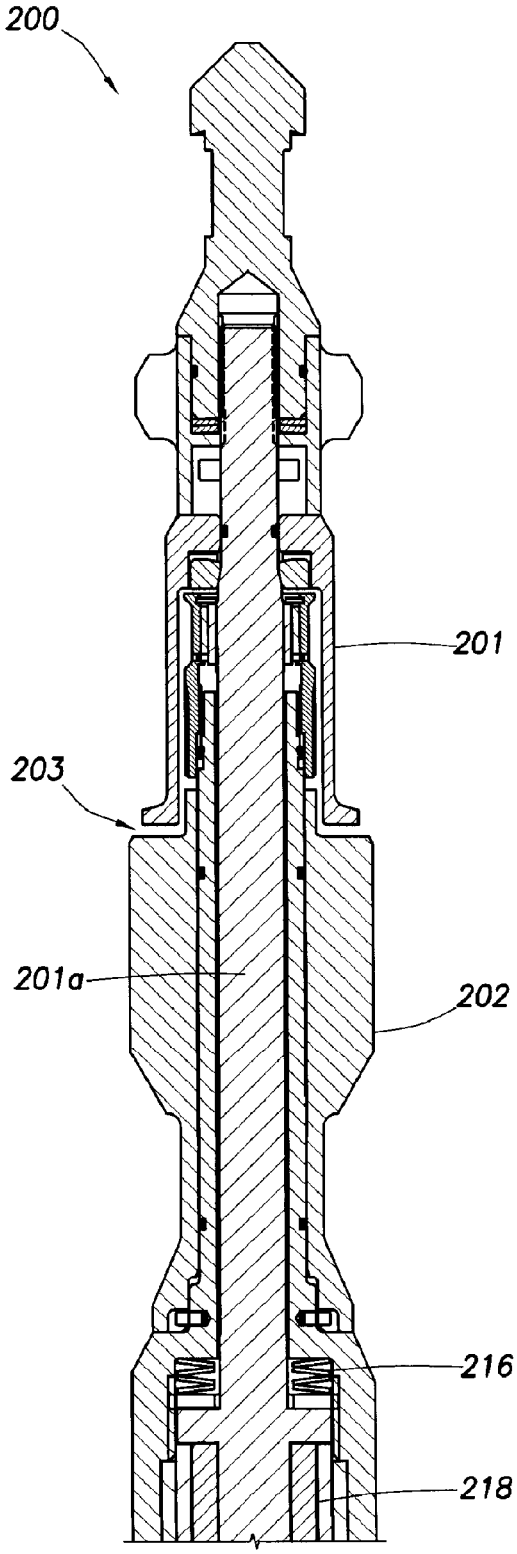
FIG.2B1
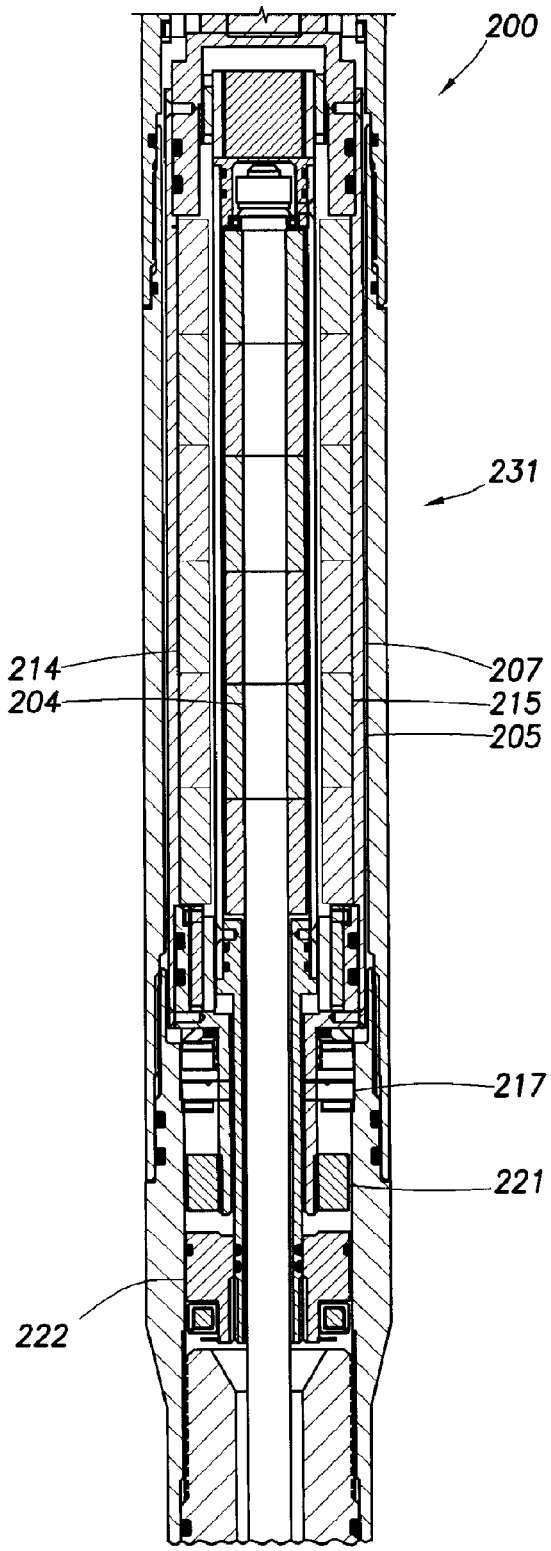
FIG.2B2

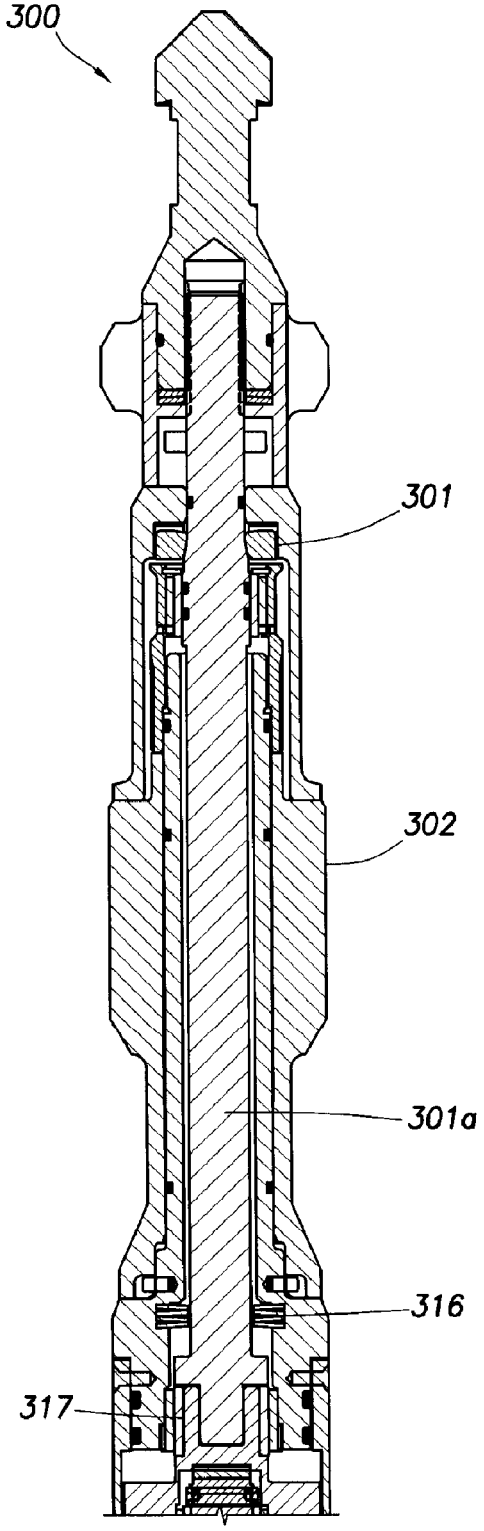
FIG.3A1
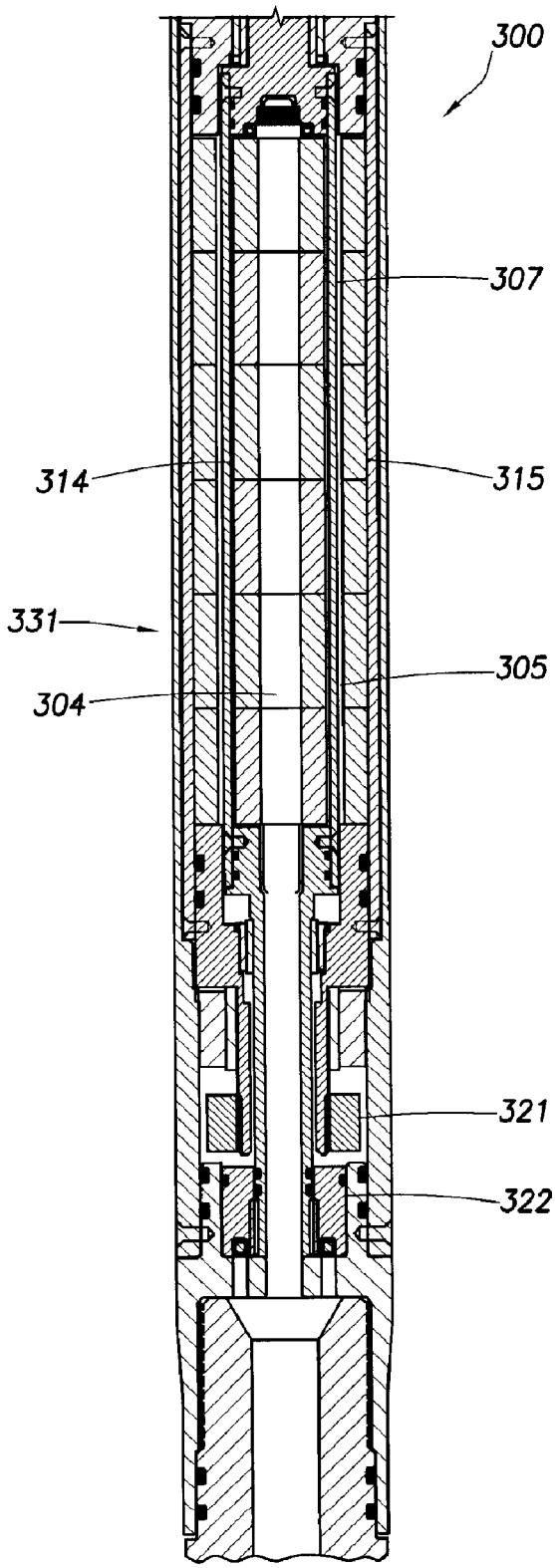
FIG.3A2

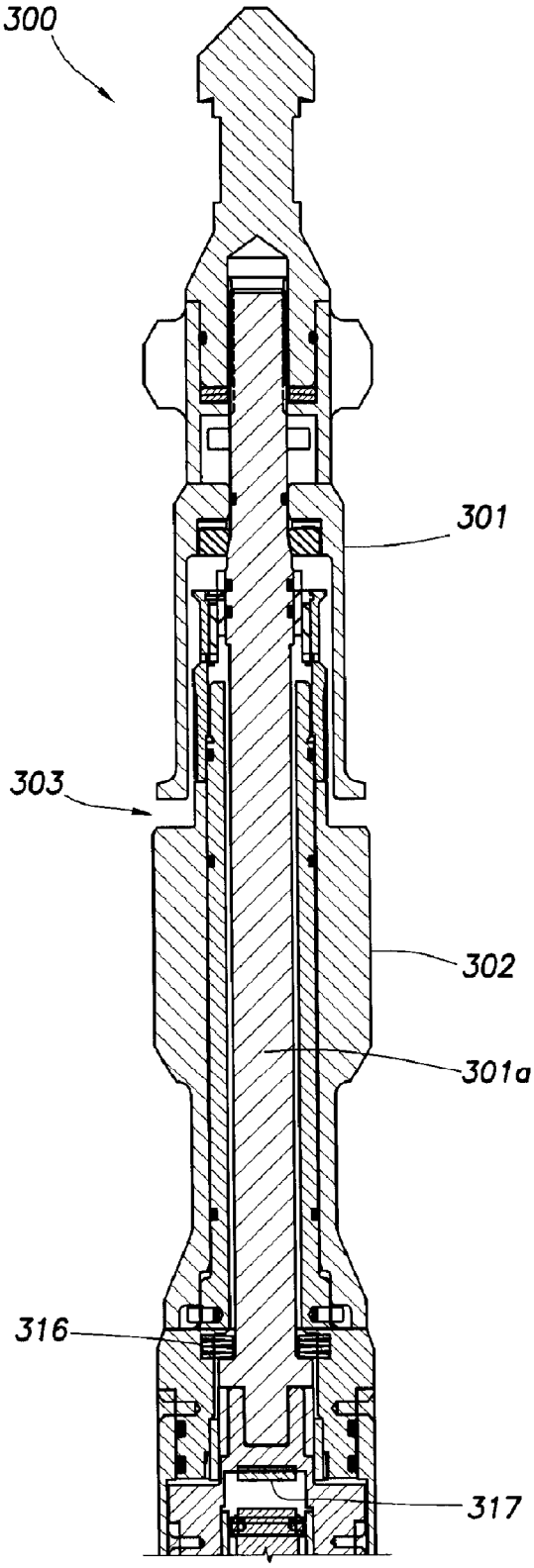
FIG.3B1
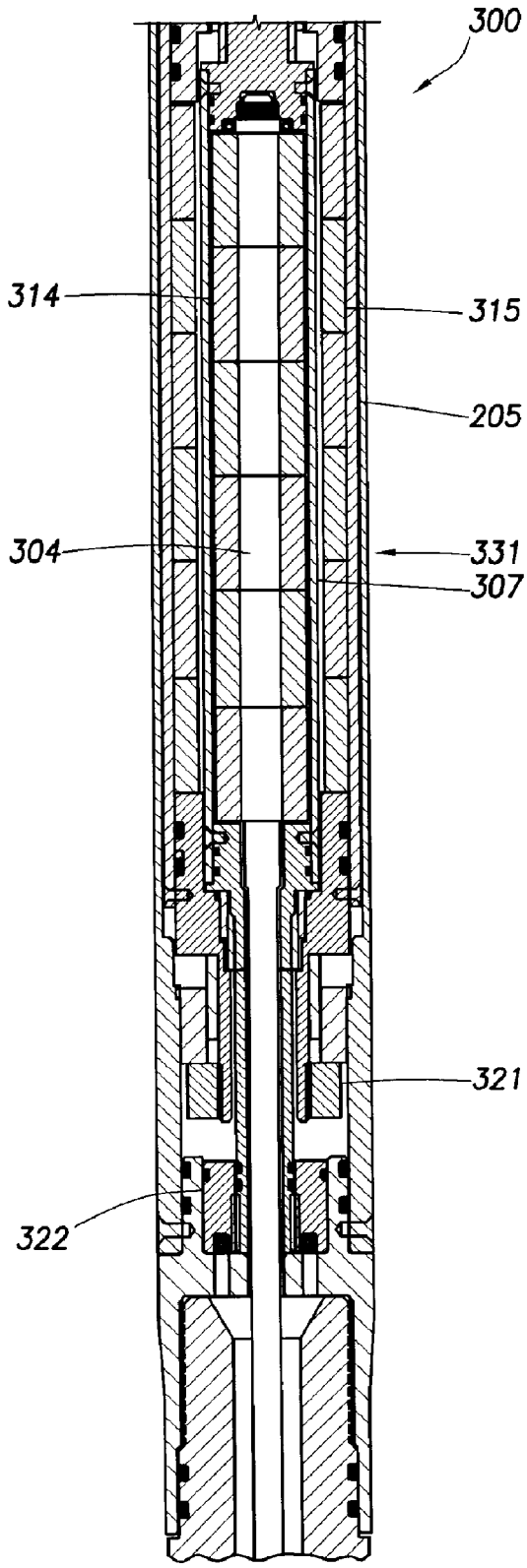
FIG.3B2

ELECTROMAGNETIC ANTI-JAM TELEMETRY TOOL

STATEMENT REGARDING FEDERALLY SPONSORED RESEARCH OR DEVELOPMENT

This invention was made with Government support under Cooperative Agreement No. DE-FC26-03NT41835 awarded by the Department of Energy (DOE). The Government may have certain rights in this invention.

BACKGROUND OF INVENTION

Wells are generally drilled into the ground to recover natural deposits of hydrocarbons and other desirable materials trapped in geological formations in the Earth's crust. A well is typically drilled using a drill bit attached to the lower end of a drill string. The well is drilled so that it penetrates the subsurface formations containing the trapped materials and the materials can be recovered.

The drilling operations are controlled by an operator at the surface. The drill string is rotated at a desired rate by a rotary table, or top drive, at the surface, and the operator controls the weight-on-bit and other operating parameters of the drilling process. At the bottom end of the drill string is a "bottom hole assembly" ("BHA"). The BHA includes the drill bit along with sensors, control mechanisms, and the required circuitry. A typical BHA includes sensors that measure various properties of the formation and of the fluid that is contained in the formation, as well as the operating conditions of the drill bit and other downhole equipment.

Another aspect of drilling and well control relates to the drilling fluid, called "mud." The mud is a fluid that is pumped from the surface to the drill bit by way of the drill string. The mud serves to cool and lubricate the drill bit, and it carries the drill cuttings back to the surface. The density of the mud is carefully controlled to maintain the hydrostatic pressure in the borehole at desired levels.

In order for the driller at the surface to be aware of the downhole conditions and for the driller to be able to control the drill bit, communication between the BHA and the surface is required. One common method of communication is called "mud pulse telemetry." Mud pulse telemetry is a method of sending signals by creating pressure and/or flow rate pulses in the mud. These pulses may be detected by sensors at the receiving location. For example, a telemetry signal may be sent from the tool to the surface as pressure pulses in the mud flow downwardly through the drill string. The pressure pulses may be detected and interpreted at the surface.

A typical downhole mud pulse telemetry tool includes a restrictor (or rotor) and a stator. The restrictor rotates with respect to the stator to vary the cross sectional area of the mud flow passage through the mud-pulse telemetry tool. Because the mud is pumped at the surface using positive displacement pumps, the flow rate of the mud will remain relatively constant. By using the restrictor and the stator to restrict the area of flow, the pressure of the mud flowing in the drill string will increase. Correspondingly, by manipulating the restrictor and stator to increase the flow area, the pressure in the drill string will decrease. Selective operation of the restrictor and stator may create specific pressure pulses in the drill string that may be sensed and interpreted at the surface.

Typically, a motor and gear train is coupled to the restrictor so that the restrictor may be selectively manipulated. In many tools, the motor/gear train is coupled directly to the restrictor. In these tools, rotary fluid seals are required to prevent the drilling fluid from contaminating the lubricant in the motor and gear train. Because of the abrasive nature of the mud, these seals are prone to failure.

One possible method for improving the reliability of a downhole mud pulse telemetry tool is to use a magnetic coupling between the motor/gear train and the restrictor. A magnetic coupling does not require a rotary seal. It enables the motor/gear train to be completely enclosed so that the mud cannot contaminate the lubricant inside the motor/gear train.

One significant problem with downhole mud pulse telemetry tools is that they occasionally become jammed with particles from the drilling mud. The occurrences of jamming increase when particles are added to the mud to correct problems such as lost circulation. The particles are used form a barrier against the borehole wall to seal the inside of the borehole from the formation so that mud will not flow into the formation. One of the side effects is that the particles become lodged between the blades of the restrictor and the stator, preventing relative rotation between them.

Techniques have been developed that prevent jamming in downhole mud pulse tools. A typical prior art anti-jam technique is to apply a much higher torque to the restrictor to cut through the jamming material. Examples of anti-jam techniques are described in U.S. Pat. No. 6,219,301, assigned to the assignee of the present invention, and U.S. application No. 2004/0069535 assigned to Baker Hughes.

Despite these advances in anti-jam technology, there remains a need for anti-jam techniques capable of operating reliably without requiring higher torque. It is further desirable that such a system be operable in devices where the restrictor is magnetically coupled to the motor/gear train. The size of the magnetic coupling may depend on the torque that the magnetic coupling is required to transmit. Moreover, the torque required to cut through particles jammed in the restrictor blades may require a magnetic coupling that is undesirably long, unstable and/or unreliable.

What is needed, therefore, is a telemetry tool with an anti-jam feature that does not require high torque for shearing lodged particles.

SUMMARY OF INVENTION

In at least one aspect, the invention relates to a mud-pulse telemetry tool that includes a tool housing, a motor disposed in the tool housing, a magnetic coupling coupled to the motor and having an inner shaft and an outer shaft, a stator coupled to the tool housing, and a restrictor disposed proximate the stator and coupled to the magnetic coupling, so that the restrictor and the stator adapted to generate selected pulses in a drilling fluid when the restrictor is selectively rotated. The tool may also include a first anti-jam magnet coupled to the tool housing, and a second anti-jam magnet disposed proximate the first anti-jam magnet and coupled to one selected from the inner shaft and the outer shaft, wherein at least one of the first anti-jam magnet and the second anti-jam magnet is an electromagnet, and wherein the first anti-jam magnet and the second anti-jam magnet are positioned with adjacent like poles.

In another aspect, the invention relates to a method of relieving a jam in a mud-pulse tool that includes detecting a jam in the mud-pulse tool, energizing an electromagnet coupled to one of a tool housing and a magnetic coupling, wherein a magnet is disposed proximate the electromagnet and coupled to the other of the tool housing and the magnetic coupling, wherein the electromagnet and the magnet are positioned with adjacent like poles, and de-energizing the electromagnet. The method may also include detecting an unjammed condition.

Other aspects and advantages of the invention will be apparent from the following description and the appended claims.

BRIEF DESCRIPTION OF DRAWINGS

FIG. 2A(1-2) show a cross section of a mud-pulse telemetry tool in a closed position in accordance with the invention;

FIG. 2B(1-2) show a cross section of the mud-pulse telemetry tool in FIG. 2A in an open position.

FIG. 3A(1-2) show a cross section of a mud-pulse telemetry tool in a closed position in accordance with the invention;

FIG. 3B(1-2) show a cross section of the mud-pulse telemetry tool in FIG. 3A in an open position.

DETAILED DESCRIPTION

Embodiments of the present invention relate to a downhole mud-pulse telemetry tool with an anti-jam feature as methods for un-jamming a mud-pulse telemetry tool. In certain embodiments, the invention relates to a mud-pulse telemetry tool with an anti-jam electromagnet that may be energized to move the tool to an open position.

Figure 1:
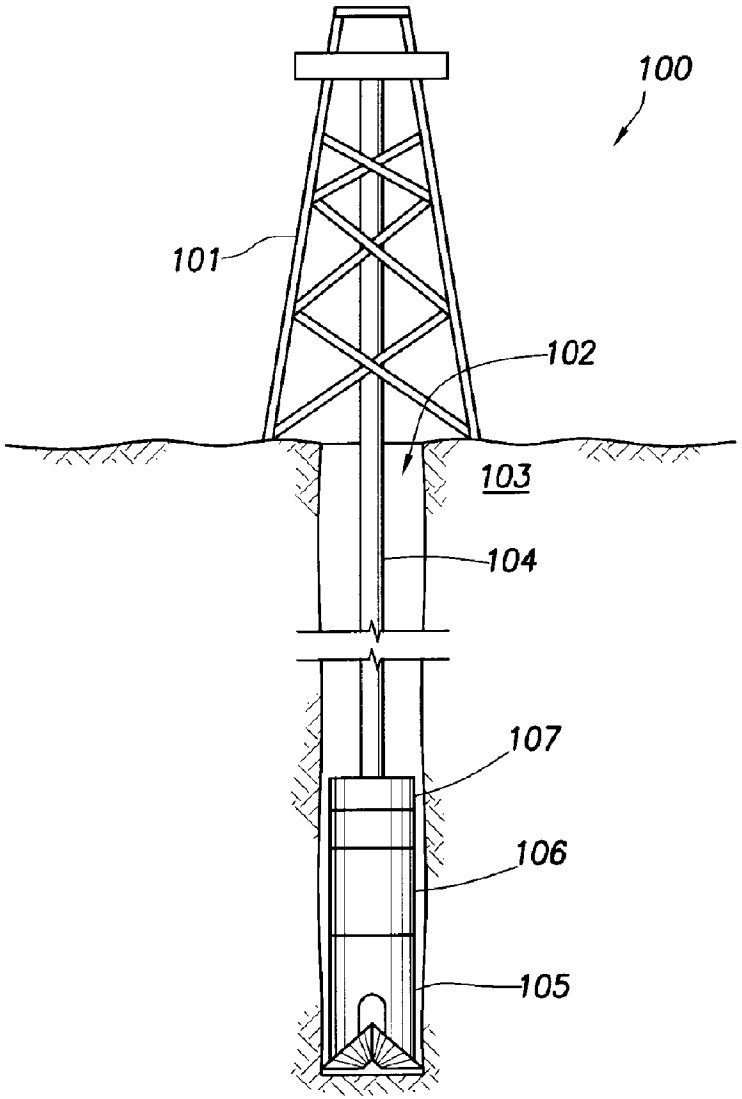
FIG. 1 shows a view of a rig with a drilling tool suspended from the rig.

FIG. 1 shows a perspective view of a drilling system 100. The drilling system 100 includes a rig 101 and a drill string 104 suspended from the rig 100. Near the bottom of the drill string 104, the drilling system includes a drill bit 105 and various drilling tools 106, 107. The drilling system is used to drill a borehole 102 in Earth formations 103. A mud pulse telemetry tool may be located in the bottom-hole-assembly ("BHA"), for example at 107. The position of the mud pulse telemetry system is not intended to limit the invention.

Mud is pumped from the surface, through the drill string 104 to the drill bit 105. The mud exits the drill bit 105 and flows back to the surface through the annulus between the drill string 104 and the borehole wall. Mud pulse telemetry is usually conducted using the downwardly flowing mud in the drill string 104. Upward communications may be conducted through the drill string, even though the mud is flowing downwardly.

FIG. 2A is a cross section of one example of a downhole mud pulse telemetry tool 200 in accordance with the invention. The tool 200 is positioned in a drill collar (not shown) forming part of the drill string 104 of FIG. 1. The tool 200 includes a restrictor 201 and a stator 202. Selective rotation of the restrictor 201 with respect to the stator 202 may generate pressure pulses in the mud flow that may be detected at the surface. In order to drive the restrictor 201, a typical tool includes a motor and gear train section (not shown in FIG. 2A).

The tool 200 in FIG. 2A includes a magnetic coupling 231 that couples the restrictor shaft 201 a of the restrictor 201 to the motor (not shown). The magnetic coupling 231 includes an inner shaft 204 and an outer shaft 205. Inner magnets 214 are mounted on the inner shaft 204 proximate outer magnets 215 that are mounted on the outer shaft 205. The inner and outer magnets 214, 215 may be normal magnets that are used in a typical magnetic coupling.

A separator shell 207 is typically included to form a fluid barrier between the inner shaft 204 and the outer shaft 205. The shell 207 prevents fluid from entering the area occupied by the inner shaft 204 and flowing to the motor (not shown). With such a shell 207 used in a magnetic coupling 231, a rotary seal may not be required.

Generally, the inner shaft 204 is coupled to a motor (not shown) in the tool 200, and the outer shaft 205 is coupled to the restrictor 201. The inner magnets 214 and outer magnets 215 are magnetically coupled together so that the outer shaft 205 will rotate with the inner shaft 204, even though the inner shaft 204 and the outer shaft 205 may not be physically connected together.

The outer shaft 205 of the telemetry tool 200 in FIG. 2A has a limited range of axial motion with respect to the inner shaft 204. A spring 216 may be included to prevent the outer shaft from impacting the tool housing during the anti-jam operation, discussed below. In general, the force from the flow of mud will keep the outer shaft 205 and the restrictor 201 in a closed position, as shown in FIG. 2A. It is noted that a closed position is shown in FIG. 2A, and an open position is shown in FIG. 2B and discussed below.

The telemetry tool shown in FIG. 2A includes a first anti-jam magnet 221 and a second anti-jam magnet 222. The first anti-jam magnet 221 is coupled to the outer shaft 205, and the second anti-jam magnet 222 is attached to the tool housing, or any other part of the tool that is stationary in the axial direction. (Refer to the figure attached with the e-mail)

The first anti-jam magnet 221 and the second anti-jam magnet 222 are positioned to have "adjacent like poles." The phrase "adjacent like poles" is used in this disclosure to refer to two magnets that are disposed near each other with like poles that are adjacent to each other. For example, two magnets with adjacent like poles may be positioned so that the North pole of each magnet is facing the other. Adjacent like poles may also include magnets with their South poles arranged to be facing each other.

In accordance with certain embodiments of the invention, at least one of the first anti-jam magnet 221 and the second anti-jam magnet 222 is an electromagnet. In FIG. 2A, the second anti-jam magnet 222 is shown as an electromagnet, but the first anti-jam magnet 221 may be an electromagnet, without departing from the scope of the invention. In addition, both the first 221 and second 222 may be electromagnets.

In order to relieve a jam in the blades of the restrictor 201, the electromagnet, which is the second anti-jam magnet 222 in FIG. 2A, is energized so that a magnetic field is induced. Because the first anti-jam magnet 221 and the second anti-jam magnet 222 have adjacent like poles, a repelling force is induced between the first anti-jam magnet 221 and the second anti-jam magnet 222 when the electromagnet is energized. The repelling force induced between the first anti-jam magnet 221 and the second anti-jam magnet 222 may cause the first anti-jam magnet 221 and the outer shaft 205 to move axially with respect to the inner shaft 204. This will, in turn, cause the restrictor shaft 201 a and the restrictor 201 to move axially with respect to the stator 202 into an open position, as shown in FIG. 2B.

FIG. 2B shows the mud pulse telemetry tool 200 from FIG. 2A, but in FIG. 2B the tool 200 is in an open position. The restrictor 201 is moved axially away from the stator 202 as shown in FIG. 2B, creating a gap 203 between the restrictor 201 and the stator 202. In some cases, the stator 202 may be configured to move away from the restrictor 202 to create a gap. The gap 203 enables the mud flow to wash away any debris that may be lodged between the blades of the restrictor 201. Once the jam is cleared, the electromagnet (e.g., the second anti-jam magnet 222 in FIG. 2B) may be de-energized, and the magnetic force will cease. The force from the flow of mud may then force the outer shaft 205 and the restrictor 201 back to the closed position, as shown in FIG. 2A.

It is noted that both the first 221 and second 222 anti-jam magnets may be electromagnets. Such a configuration does not depart from the scope of the invention. In that case, both electromagnets would have to be energized to induce the repelling force to move the restrictor to the open position.

The telemetry tool 200 may include a thrust bearing 217 near the anti-jam magnets 221, 222. The thrust bearing 217 absorbs the axial loads created by the axial movement of the outer shaft 205, as well as any axial loads created by the rotation of the outer 205 shaft. The thrust bearing 217 also absorbs the load from the flowing mud in normal operating conditions.

The telemetry tool 200 shown in FIGS. 2A and 2B includes a radial bearing 218, as well. The radial bearing 218 absorbs any side or radial loads that may result from the rotation of the inner 204 and outer 205 shafts, as well as radial forces generated in the axial movement of the outer shaft 205 when the electromagnet (e.g., the second anti-jam magnet 222 in FIGS. 2A and 2B) is energized.

FIG. 3A shows a telemetry tool 300 that is similar to the tool 200 in FIGS. 2A and 2B, except that thrust bearing 317 in the tool the tool 300 in FIG. 3A is in a different position. The telemetry tool 300 includes a restrictor 301 and a stator 302. The restrictor 301 is driven by a motor (not shown), which is coupled to the restrictor 301 by a magnetic coupling 331. The inner shaft 304, including inner magnets 314, and the outer shaft 305, including outer magnets 315, form the magnetic coupling 331. The inner magnets 314 and the outer magnets 315 ensure that the inner 304 and outer 305 shafts rotate together. A separator shell 307 is positioned between the inner shaft 304 and the outer shaft 305. The outer shaft 305 is coupled to the restrictor shaft 301*a*. Rotation of the outer shaft 305 causes the restrictor 301 to rotate with respect to the stator 302.

A first anti-jam magnet 321 is coupled to the outer shaft 305, and a second anti-jam magnet 322 is coupled to the housing. The first anti-jam magnet 321 and the second anti-jam magnet 322 are positioned to have adjacent like poles (i.e., North-North or South-South). At least one of the first anti-jam magnet 321 and the second anti-jam magnet 322 is preferably an electromagnet. The second anti-jam magnet 322 is shown as an electromagnet in FIG. 3A.

When the electromagnet (e.g., the second anti-jam magnet 322 in FIG. 3A) is energized, the repelling force induced between the first anti-jam magnet 321 and the second anti-jam magnet 322 may cause the first anti-jam magnet 321 and the outer shaft 305 to move axially with respect to the inner shaft 304. This will, in turn, cause the restrictor shaft 301*a* and the restrictor 301 to move axially with respect to the stator 302 into an open position, as shown in FIG. 3B. A gap 303 will enable particles lodged between the restrictor 301 and the stator 302 to be washed away by the mud flow. A spring 316 may be included to prevent the outer shaft from impacting the tool housing during the anti-jam operation. When the electromagnet is not energized, force from the flowing mud, forces the outer shaft 305 and the restrictor 301 into a closed position, shown in FIG. 3A.

The tool 300 may also include a thrust bearing 317 that absorbs any axial loads that are generated from the axial or rotational movement of the outer shaft 305. In the position shown in FIGS. 3A and 3B, the thrust bearing 317 is above the inner shaft 304. In this particular example, the thrust bearing 317 does not form a ring around the inner shaft 304. Because of this, the thrust bearing 317 may have a smaller diameter than that of the thrust bearing 217 in the tool 200 shown in FIGS. 2A and 2B.

In general, the magnitude of a torque or a moment is determined by the force creating the torque or moment multiplied by the distance to the center of rotation of the object on which the torque or moment acts. In the case of a thrust bearing, the maximum distance corresponds to the outside radius of the thrust bearing (i.e., from the outer edge of the thrust bearing to the centerline of the tool). The thrust bearing 317 in FIGS. 3A and 3B preferably has a smaller diameter than that of the thrust bearing 217 in FIGS. 2A and 2B. This smaller diameter is designed to generate less frictional torque to oppose the rotation of the outer shaft 305 in normal operation of the telemetry tool 300.

A computer or processor may be provided in the downhole tool to control the tool during operation. In some cases, because of the slow telemetry rate while drilling, downhole computers may be used to analyze data and make decisions about how to proceed. Such computers may be used in connection with the present invention. For example, a downhole computer associated with a telemetry tool may monitor the rotational speed of the restrictor in the telemetry tool. In the event that the restrictor and stator become jammed, the restrictor may stop rotating with respect to the stator. The downhole computer may recognize this condition as a jam. Once the jam is recognized, the downhole computer may energize the anti-jam electromagnet, in accordance with embodiments of the invention, to un-jam the telemetry tool.

In addition, a downhole computer may be used to detect the rotation of the restrictor once the jam has been cleared. Upon detection of such rotation, the downhole computer may de-energize the anti-jam electromagnet to return the telemetry tool to a closed position.

Figure 4:
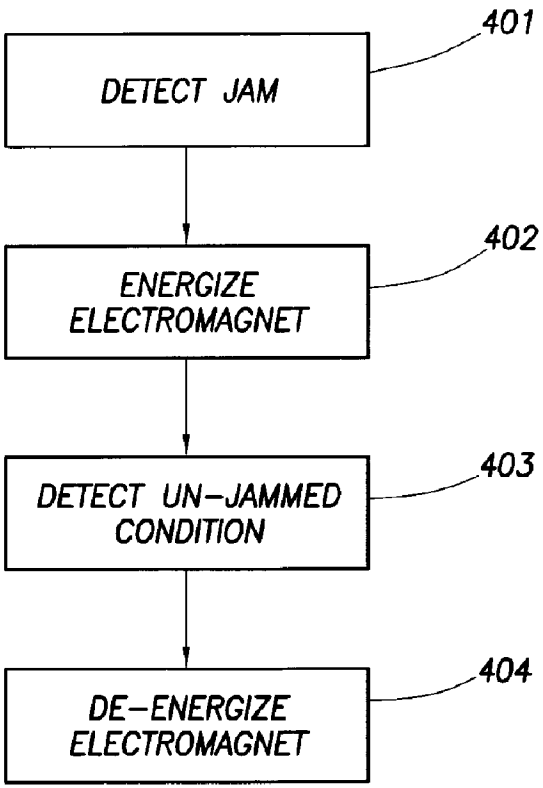
FIG. 4 shows a method in accordance with the invention.

FIG. 4 shows a method for un-jamming a downhole telemetry tool. The method may first include detecting a jammed condition, at 401. This may be accomplished by observing an increase in the required torque of a telemetry tool or by observing that the restrictor of a telemetry tool is not rotating as desired. Some tools may include electronics that are configured to identify such conditions and identify a jammed condition.

In another example, a telemetry tool in accordance with embodiments of the invention may include a motor that does not generate enough torque to shear material that may be causing the jam. In such a case, the restrictor rotation with respect to the stator would stop because of the jam. Such a stoppage may be identified as a jammed condition. A downhole computer may identify a stoppage as a jammed condition.

The method may next include energizing an anti-jam electromagnet, at 402. This may induce a repulsive force between the anti-jam electromagnet and another anti-jam magnet located proximate the anti-jam electromagnet. Such an additional magnet may be positioned so that the anti-jam electromagnet and the additional anti-jam magnet have adjacent like poles. The repulsive force may cause an axial movement of the restrictor (or stator) that will create a gap between the restrictor and the stator that is sufficient for the mud flow to sweep away the material causing the jam.

In some cases, the method may include detecting an un-jammed condition, at 403. This may be done by observing that the restrictor is again able to rotate with respect to the stator. In other cases, an un-jammed condition may be detected. For example, detecting an un-jammed condition may include inducing an amount of torque that is sufficient to rotate the restrictor in an un-jammed condition, but not in a jammed condition. When the restrictor begins to rotate, the restrictor is no longer jammed. The anti-jam electromagnet may then be de-energized.

The method may also include de-energizing the anti-jam electromagnet, at 404. In some cases, the anti-jam electromagnet may be energized for a preselected period of time that is likely to dislodge the particles that are causing the jam. In this case, there is no need to detect an un-jammed condition, as shown at 403.

In some cases, a method in accordance with some embodiments of the invention may be performed entirely by a downhole computer. For example, in a telemetry tool that is only able to provide enough torque to rotate the restrictor in an un-jammed condition, a jammed condition may be detected by the stopping of the restrictor, even when the motor is engaged. When the restrictor stops, the downhole computer may energize the anti-jam electromagnet to axially displace the restrictor and create a gap. Once the restrictor is able to rotate again, the downhole computer may detect an un-jammed condition and de-energize the anti-jam electromagnet.

Certain embodiments of the present invention may present one or more of the following advantages.

Advantageously, some embodiments of the present invention may enable a telemetry tool to be anti-jammed without applying the torque required to shear the material jamming the telemetry tool. Without the need for shearing torque, the motor may be coupled to the restrictor using a magnetic coupling. Advantageously, a magnetic coupling may not include rotary seals that are subject to failure when exposed to abrasive drilling mud.

Advantageously, some embodiments of the present invention may enable detection of a jammed condition. Detection of a jammed condition provides information to the operator or a computer in a downhole tool that the telemetry signal being sent may have been affected by the jam in the telemetry tool. The signal may be retransmitted.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A mud-pulse telemetry tool, comprising:

a tool housing;

a motor disposed in the tool housing;

a magnetic coupling coupled to the motor and having an inner shaft and an outer shaft;

a stator coupled to the tool housing;

a restrictor disposed proximate the stator and coupled to the magnetic coupling, the restrictor and the stator adapted to generate selected pulses in a drilling fluid when the restrictor is selectively rotated;

a first anti-jam magnet coupled to the tool housing; and an second anti-jam magnet disposed proximate the first anti-jam magnet and coupled to one selected from the inner shaft and the outer shaft, wherein at least one of the first anti-jam magnet and the second anti-jam magnet is an electromagnet, and wherein the first anti-jam magnet and the second anti-jam magnet are positioned with adjacent like poles.

2. The mud-pulse telemetry tool of claim 1, wherein the first anti-jam magnet is an electromagnet.

3. The mud-pulse telemetry tool of claim 2, wherein the second anti-jam magnet is a second electromagnet.

4. The mud-pulse telemetry tool of claim 1, wherein the first anti-jam magnet is coupled to the outer shaft.

5. The mud-pulse telemetry tool of claim 1, wherein the restrictor is coupled to the outer shaft of the magnetic coupling.

6. The mud-pulse telemetry tool of claim 5, further comprising a spring positioned to prevent the outer shaft from impacting the tool housing.

7. The mud-pulse telemetry tool of claim 1, further comprising a radial bearing.

8. The mud-pulse telemetry tool of claim 1, further comprising a thrust bearing.

9. The mud-pulse telemetry tool of claim 8, wherein the thrust bearing is disposed proximate the first anti-jam magnet and around the inner shaft.

10. The mud-pulse telemetry tool of claim 8, wherein the thrust bearing is disposed proximate a coupling that couples the outer shaft to a shaft of the restrictor such that the thrust bearing is not formed around the inner shaft.

11. The mud-pulse telemetry tool of claim 1, wherein restrictor and the stator are disposed proximate a first end of the tool, and the first anti-jam magnet and the second anti-jam magnet are disposed proximate a second end of the tool.

12. The mud-pulse telemetry tool of claim 1, further comprising a downhole computer configured to energize the electromagnet among the first anti-jam magnet and the second anti-jam magnet when the downhole computer detects a jammed condition.

13. A method of relieving a jam in a mud-pulse tool, comprising:

detecting a jam in the mud-pulse tool;

energizing an electromagnet coupled to one of a of mud-pulse tool housing and a magnetic coupling, wherein a magnet is disposed proximate the electromagnet and coupled to the other of the tool housing and the magnetic coupling, wherein the electromagnet and the magnet are positioned with adjacent like poles; and de-energizing the electromagnet.

14. The method of claim 13, further comprising detecting an unjammed condition.

15. The method of claim 14, wherein the electromagnet is coupled to the tool housing and the magnet is coupled to an outer shaft of the magnetic coupling.

16. The method of claim 14, wherein the energizing an electromagnet comprises energizing a first electromagnet and energizing a second electromagnet.

17. A downhole tool, comprising:

a tool housing;

a motor disposed in the tool housing;

a magnetic coupling coupled to the motor and having an inner shaft and an outer shaft;

a stator coupled to the tool housing;

a restrictor disposed proximate the stator and coupled to the magnetic coupling, the restrictor and the stator adapted to generate selected pulses in a drilling fluid when the restrictor is selectively rotated;

a first anti-jam magnet coupled to the too housing; and an second anti-jam magnet disposed proximate the first anti-jam magnet and coupled to one selected from the inner shaft and the outer shaft, wherein at least one of the first anti-jam magnet and the second anti-jam magnet is an electromagnet, and wherein the first anti-jam magnet and the second anti-jam magnet are positioned with adjacent like poles.

18. The mud-pulse telemetry tool of claim 17, wherein the first anti-jam magnet is an electromagnet.

19. The mud-pulse telemetry tool of claim 18, wherein the second anti-jam magnet is a second electromagnet.

20. The mud-pulse telemetry tool of claim 17, further comprising a downhole computer configured to energize the electromagnet among the first anti-jam magnet and the second anti-jam magnet when the downhole computer detects a jammed condition.

* * * * *